US009840760B2

(12) United States Patent
Kino et al.

(10) Patent No.: US 9,840,760 B2
(45) Date of Patent: Dec. 12, 2017

(54) POWDER MADE OF IRON-BASE METALLIC GLASS

(71) Applicant: SINTOKOGIO, LTD., Nagoya-Shi, Aichi (JP)

(72) Inventors: Yasushi Kino, Toyokawa (JP); Shingo Hayashi, Toyokawa (JP); Takuya Harada, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 0 days.

(21) Appl. No.: 14/440,521

(22) PCT Filed: Jun. 26, 2013

(86) PCT No.: PCT/JP2013/004004
§ 371 (c)(1),
(2) Date: May 4, 2015

(87) PCT Pub. No.: WO2014/136148
PCT Pub. Date: Sep. 12, 2014

(65) Prior Publication Data

US 2016/0298216 A1 Oct. 13, 2016

(30) Foreign Application Priority Data

Mar. 4, 2013 (JP) ..... 2013-042029

(51) Int. Cl.

| | |
|---|---|
| ***C22C 45/02*** | (2006.01) |
| ***H01F 1/153*** | (2006.01) |
| ***C22C 45/00*** | (2006.01) |
| ***B22F 9/00*** | (2006.01) |
| ***C22C 33/00*** | (2006.01) |
| ***C22C 33/02*** | (2006.01) |
| ***C22C 45/04*** | (2006.01) |
| ***C22C 1/00*** | (2006.01) |
| ***B22F 9/08*** | (2006.01) |
| ***H01B 3/02*** | (2006.01) |
| ***H01F 1/03*** | (2006.01) |
| *H01F 1/20* | (2006.01) |

(52) U.S. Cl.

CPC ..... *C22C 45/008* (2013.01); *B22F 9/002* (2013.01); *B22F 9/08* (2013.01); *C22C 1/002* (2013.01); *C22C 33/003* (2013.01); *C22C 33/02* (2013.01); *C22C 45/02* (2013.01); *C22C 45/04* (2013.01); *H01B 3/02* (2013.01); *H01F 1/0306* (2013.01); *B22F 9/082* (2013.01); *B22F 2009/0828* (2013.01); *B22F 2009/0836* (2013.01); *C22C 2200/02* (2013.01); *H01F 1/15308* (2013.01); *H01F 1/20* (2013.01)

(58) Field of Classification Search
None
See application file for complete search history.

(56) References Cited

U.S. PATENT DOCUMENTS

| | | | | |
|---|---|---|---|---|
| 2007/0258842 | A1* | 11/2007 | Lu | C22C 33/0257 419/10 |
| 2007/0292298 | A1 | 12/2007 | Imori et al. | |
| 2007/0295429 | A1 | 12/2007 | Yi et al. | |
| 2008/0078474 | A1* | 4/2008 | Naito | C22C 33/0207 148/304 |
| 2011/0265915 | A1* | 11/2011 | Tsuchiya | B82Y 25/00 148/307 |
| 2012/0318412 | A1* | 12/2012 | Ohta | C21D 8/1211 148/548 |

FOREIGN PATENT DOCUMENTS

| | | |
|---|---|---|
| CN | 101061246 A | 10/2007 |
| JP | 2002-080949 | 3/2002 |
| JP | 2005-290468 | 10/2005 |
| JP | 2007-231415 | 9/2007 |

OTHER PUBLICATIONS

Kim, J.C. et al.: "Synthesis and densification of Cu added Fe-based BMG composite powders by gas atomization and electrical explosion of wire," Journal of Alloys and Compounds, Elsevier Sequoia, Lausanne, CH vol. 483, No. 1-2, Aug. 26, 2009, pp. 28-31.

International Search Report in corresponding Application WO 2014-136148 A1, published Sep. 12, 2014, mailed from European Patent Office.

* cited by examiner

*Primary Examiner* — George Wyszomierski
(74) *Attorney, Agent, or Firm* — Finnegan, Henderson, Farabow, Garrett & Dunner LLP

(57) ABSTRACT

The present invention is to provide powder made of iron-based metallic glass, the corrosion resistance of which is improved over the conventional powder made of iron-based metallic glass. The basic composition includes a group of iron-based metallic elements that predominantly has Fe, a group of metalloid elements that consists of Si, B, P, and C, and a little amount of a group of elements for improving the degree of supercooling that consists of either or both of Nb and Mo. The powder made of the iron-based metallic glass is obtained by adding to the basic composition an element for improving the corrosion resistance. The obtained powder made of the iron-based metallic glass has an excellent corrosion resistance, an excellent magnetic property, and an excellent insulating property.

8 Claims, 2 Drawing Sheets

[Fig. 1]
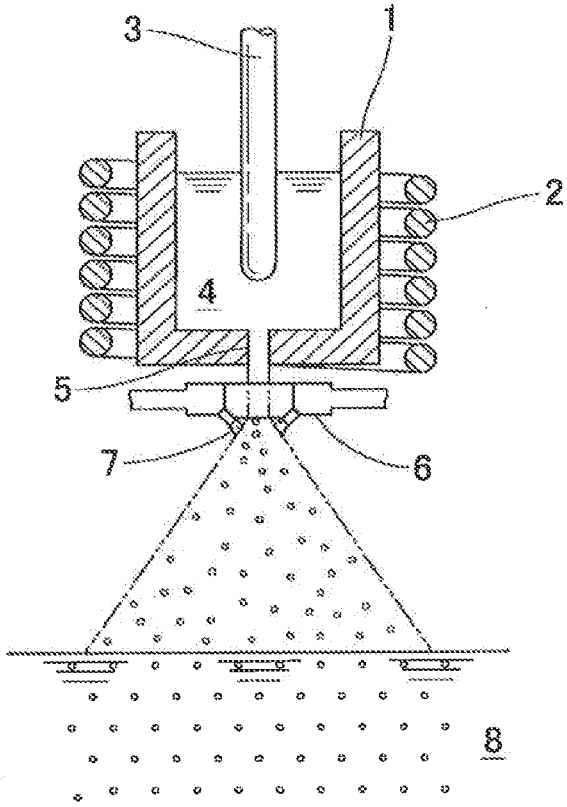

[Fig. 2]
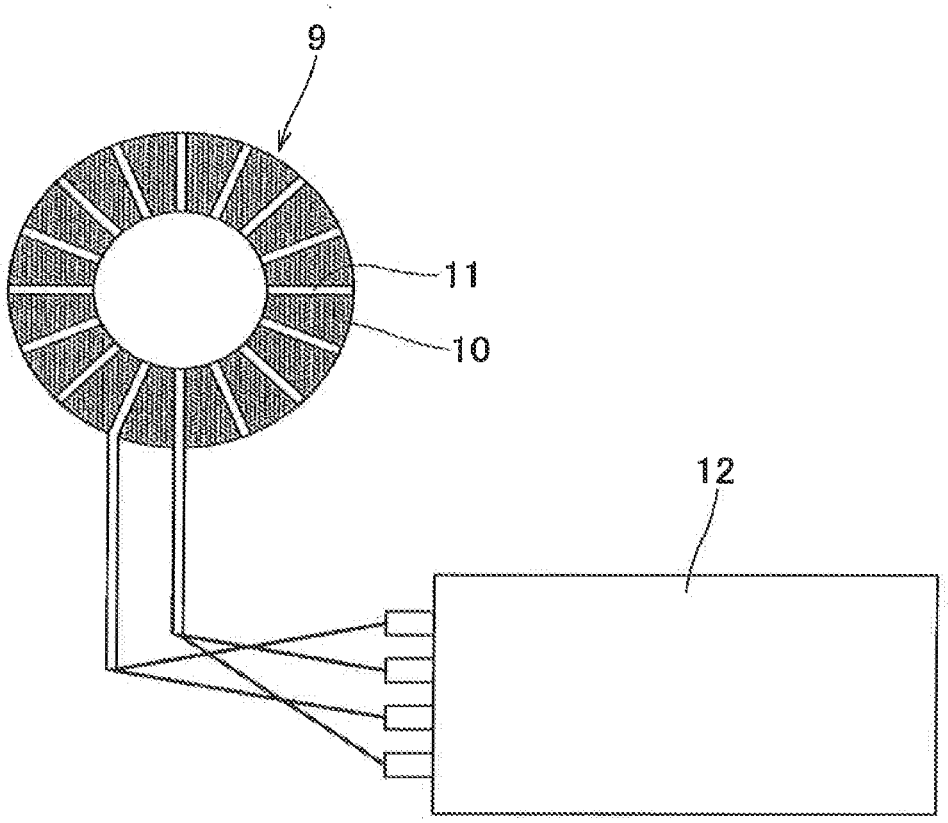

POWDER MADE OF IRON-BASE METALLIC GLASS

TECHNICAL FIELD

The present invention provides powder made of iron-based metallic glass that is based on general-purpose iron-based metallic elements and is preferably used for a material for an electronic component that has a higher corrosion-resistance than a conventional one.

BACKGROUND ART

Since powder made of iron-based metallic glass has an excellent magnetic property when it is molded by compacting powders, it is expected to be widely used for magnetic materials to be used to manufacture electronic components, such as inductors and choking coils.

Some kinds of amorphous iron-based metallic glass have been discovered in the past. Since the conventional iron-based metallic glass was manufactured by adding many rare elements (rare metals), such as Ga, Pd, and Zr, to obtain a stable amorphous structure, the cost to manufacture it was high. Further, it was manufactured in a non-oxidizing atmosphere under a great degree of supercooling, to obtain a stable amorphous structure. Though the iron-based metallic glass that is manufactured in this way has a good magnetic property, in practice it has not been used due to its cost.

The degree of supercooling is defined by ΔTx, which is calculated by this equation:

$$\Delta Tx = Tx - Tg,$$

where Tx: the recrystallization temperature, and

Tg: the glass-transition temperature.

To solve these problems, iron-based metallic glass that consists of elements that are comparatively cheap, and that can be manufactured in the atmosphere, was proposed in Japanese Patent Laid-open Publication No. 2002-080949. However, the proposed iron-based metallic glass contains, in addition to Fe, large amount of Co, Ni, and Mo as essential elements. These elements are more expensive than Fe. Thus its cost would increase.

Japanese Patent Laid-open Publication No. 2005-290468 proposes iron-based metallic glass that contains no expensive rare metal, is based on iron, which is a cheap element, and has an amorphous structure that is easily obtained in the atmosphere. The proposed iron-based metallic glass should be preferably used for electronic materials, since it has a good magnetic property. However, components of technically advanced electronic devices, such as a magnetic core for a mobile terminal, have recently been required to have a higher corrosion-resistance.

The objects of the present invention are to solve the problems and to provide powder made of the iron-based metallic glass that has an improved magnetic property, an improved insulating property, and an improved corrosion-resistance, based on the powder that is made of the iron-based metallic glass in Japanese Patent Laid-open Publication No. 2005-290468.

DISCLOSURE OF INVENTION

The powder made of iron-based metallic glass as an embodiment of the present invention is an iron-based metallic glass that consists of a group of iron-based metallic elements, a group of metalloid elements, and a group of elements for improving the degree of supercooling (M: either or both of Nb and Mo), wherein its nominal composition is expressed by $(Fe_{1-s-t}Co_sNi_t)_{100-x-y}\{(Si_aB_b)_m(P_cC_d)_n\}_xM_y$. The ratios of the compositions of the group of iron-based metallic elements are $19 \le x \le 30$, $0 < y \le 6$, $0 \le s \le 0.35$, $0 \le t \le 0.35$, and $s+t \le 0.35$. The ratios of the compositions of the group of metalloid elements are $(0.5:1) \le (m:n) \le (6:1)$; $(2.5:7.5) \le (a:b) \le (5.5:4.5)$; and $(5.5:4.5) \le (c:d) \le (9.5:0.5)$. Either or both of Cr and Zr are added to the iron-based metallic glass as an element for improving the corrosion resistance. The content of the element for improving the corrosion resistance is 0.3-5.5 wt %. Since either or both of Cr and Zr are added as an element for improving the corrosion resistance, an oxide film (an oxide layer) is formed on the surface of the powder made of the iron-based metallic glass. Thus powder made of the iron-based metallic glass that has an excellent magnetic property, an excellent insulating property, and an excellent corrosion resistance, is manufactured at a low cost.

The "content" of an element of an alloy denotes the content (wt %) of the element in relation to the total amount of the powder made of the iron-based metallic glass that contains additive elements (an element for improving the corrosion resistance plus an accessory element for also improving corrosion resistance). The ratio of the compositions in the nominal composition denotes atomic percent (at %) or atomic ratio, unless otherwise noted.

The elements for improving the corrosion resistance may include Al, wherein the content of the Al is 0.03-0.5 wt %, and wherein the total content of the elements for improving the corrosion resistance that include Al is 1.0-5.0 wt %. Since the elements for improving the corrosion resistance are any of 1) Cr and Al, or 2) Zr and Al, or 3) Cr, Al, and Zr, the corrosion resistance and the properties needed for the powder made of the iron-based metallic glass are improved by the synergistic effects of these elements.

The nominal composition may be expressed by $Fe_{100-x-y}\{(Si_aB_b)_m(P_cC_d)_n\}_xM_y$. Since the powder made of the iron-based metallic glass contains no Co or Ni, it can be manufactured at an even lower cost.

The ratio of the composition of the group of elements for improving the degree of supercooling may be $0.05 \le y \le 2.4$. Since adding an element for improving the corrosion resistance does not affect the amorphous structure of the powder made of the iron-based metallic glass that is manufactured, powder made of the iron-based metallic glass that has an excellent magnetic property, an excellent insulating property, and an excellent corrosion resistance can be manufactured.

The ratio of the compositions of the group of metalloid elements may be $(1.5:1) \le (m:n) \le (5.5:1)$; $(3.5:6.5) \le (a:b) \le (5.5:4.5)$; and $(6.0:4.0) \le (c:d) \le (8.5:1.5)$. By using these compositions, the magnetic property of the powder made of the iron-based metallic glass can be further improved.

The powder made of the iron-based metallic glass may additionally include an accessory element for improving corrosion resistance that is at least one that is selected from V, Ti, Ta, Cu, and Mn, wherein the total content of the accessory elements for improving corrosion resistance is 0.03-0.70 wt %. By adding a small amount of the accessory element for improving corrosion resistance, an oxide film is formed on the surface of the powder made of the iron-based metallic glass, and the specific resistance of the powder can be improved by the synergistic effects of the accessory element combined with the element for improving the corrosion resistance.

The diameters of the particles of the powder made of the iron-based metallic glass may be 0.5-50 μm. The powder made of the iron-based metallic glass has excellent corrosion resistance even when it is made as fine powder. Thus it is preferably used for a material for an electronic component that has an excellent performance. The diameter of the particle denotes the mean particle diameter (median: d50), unless otherwise noted.

The powder made of the iron-based metallic glass may be manufactured by water atomization. Since it is manufactured in the atmosphere, it can be manufactured at a low cost. Further, the powder made of the iron-based metallic glass that is manufactured by water atomization is produced as fine and spherical-shaped particles of powder. Thus eddy-current loss is reduced and the density of the packed powder made of the iron-based metallic glass increases so as to improve the performance of an electronic component.

The powder made of the iron-based metallic glass as another embodiment of the present invention is an iron-based metallic glass that consists of a group of iron-based metallic elements, a group of metalloid elements, and a group of elements for improving the degree of supercooling (M: either or both of Nb and Mo), wherein the nominal composition of the powder made of the iron-based metallic glass is expressed by $(Fe_{1-s-t}Co_sNi_t)_{100-x-y}\{(Si_aB_b)_m(P_cC_d)_n\}_xM_y$. The ratios of the compositions of the group of iron-based metallic elements are $19 \le x \le 30$; $0 < y \le 6$; $0 \le s \le 0.35$; $0 \le t \le 0.35$; and $s+t \le 0.35$. The ratios of the compositions of the group of metalloid elements are $(0.5:1) \le (m:n) \le (6:1)$; $(2.5:7.5) \le (a:b) \le (5.5:4.5)$; and $(5.5:4.5) \le (c:d) \le (9.5:0.5)$. Further, at least one of V, Ti, Ta, Cu, and Mn is added as an element for improving the corrosion resistance, wherein the content of that element for improving the corrosion resistance is 0.03-0.70 wt %. Since the amount of the element for improving the corrosion resistance is very small, the powder made of the iron-based metallic glass that has an excellent corrosion resistance is manufactured at a low cost.

The ratio of the compositions of the group of elements for improving the degree of supercooling may be $0.05 \le y \le 2.4$. Since adding an element for improving the corrosion resistance does not affect the amorphous structure of the powder made of the iron-based metallic glass that is manufactured, powder made of the iron-based metallic glass that has an excellent magnetic property and excellent corrosion resistance can be manufactured.

The powder made of the iron-based metallic glass of the present invention (both embodiments) has excellent magnetic and insulating properties and excellent corrosion resistance. Thus it is preferably used for a material for molding by compacting powders for various kinds of electronic components and used for a material for coating to form a magnetic film on an electronic circuit board, etc.

The basic Japanese patent application, No. 2013-042029, filed Mar. 4, 2013, is hereby incorporated by reference in its entirety in the present application.

The present invention will become more fully understood from the detailed description given below. However, the detailed description and the specific embodiments are only illustrations of desired embodiments of the present invention, and so are given only for an explanation. Various possible changes and modifications will be apparent to those of ordinary skill in the art on the basis of the detailed description.

The applicant has no intention to dedicate to the public any disclosed embodiment. Among the disclosed changes and modifications, those which may not literally fall within the scope of the present claims constitute, therefore, a part of the present invention in the sense of the doctrine of equivalents.

The use of the articles "a," "an," and "the" and similar referents in the specification and claims are to be construed to cover both the singular and the plural, unless otherwise indicated herein or clearly contradicted by the context. The use of any and all examples, or exemplary language (e.g., "such as") provided herein is intended merely to better illuminate the invention, and so does not limit the scope of the invention, unless otherwise stated.

BRIEF DESCRIPTION OF DRAWINGS

FIG. 1 is a conceptual and sectional illustration of the device for water atomizing that is used for manufacturing the powder made of the iron-based metallic glass of the present invention.

FIG. 2 is a conceptual illustration showing the method for measuring the magnetic permeability and loss of magnetism of the magnetic powder core that is used to construct a choking coil, which core is manufactured by using the powder made of the iron-based metallic glass of the present invention.

BEST MODE FOR CARRYING OUT THE INVENTION

The powder made of the iron-based metallic glass of the present invention is based on the nominal composition, $(Fe_{1-s-t}Co_sNi_t)_{100-x-y}\{(Si_aB_b)_m(P_cC_d)_n\}M_y$, that is disclosed in Japanese Patent Laid-open Publication No. 2005-290468. It comprises a group of iron-based metallic elements that is predominantly made of Fe, a group of metalloid elements, and a group of elements for improving the degree of supercooling (M: either or both of Nb and Mo). Below the nominal composition of the iron-based metallic glass and the ratios of the compositions of the elements that constitute the iron-based metallic glass of the present invention are discussed in view of that publication.

By adjusting the ratios of the compositions in the nominal composition (basic composition), iron-based metallic glass wherein the degree of supercooling, $\Delta Tx$, is 40 K or less, can be obtained. In the nominal composition the ratios of the compositions of the groups are $19 \le x \le 30$, $0 < y \le 6$, $0 \le s \le 0.35$, $0 \le t \le 0.35$, and $s+t \le 0.35$.

In the group of iron-based metallic elements, i.e., $(Fe_{1-s-t}Co_sNi_t)$, if $s+t > 0.35$, the content of the Co or the Ni increases, to thereby increase the cost of material. Further, the degree of supercooling decreases to a range that cannot be measured. Thus a degree of supercooling over 40 K, which is one of the conditions to obtain an amorphous structure, cannot be achieved.

Even when no Co or Ni, which are elements of iron-based metal and which are not Fe, is contained, the degree of supercooling over 40 K can be achieved.

It is generally preferable that the ratio x of the total compositions of the group of metalloid elements, i.e., $\{(Si_aB_b)_m(P_cC_d)_n\}_x$, be in the range of $19 \le x \le 30$. However, considering both the degree of supercooling and the magnetic property, the range of $21 \le x \le 27$ is more preferable.

If $x < 19\%$, the degree of supercooling of $\Delta Tx \ge 40K$ is not achieved. Thus a single amorphous phase cannot be generally obtained. If $x > 30\%$, the cost of the material increases, and as the amount of Fe decreases the magnetic property is degraded.

In the range of the total compositions of the group of metalloid elements, x, the ratios of the compositions (a, b, m, c, d, and n) of the elements (Si, B, P, and C) that constitute the group of metalloid elements are the following.

The ratio (m:n) of the sum (m) of Si plus B to the sum (n) of P plus C is the range in (0.5:1)≤(m:n)≤(6:1). In that range of m, the ratio (a:b) of Si to B is (2.5:7.5)≤(a:b)≤(5.5:4.5). In that range of n, the ratio (c:d) of P to C is (5.5:4.5)≤(c:d)≤(9.5:0.5).

If the ratio of the composition of Si, B, P, or C is outside of those ranges, the degree of supercooling of ΔTx≥40K cannot not be achieved.

To improve the magnetic property, the powder made of the iron-based metallic glass of the present invention contains either or both of Nb and Mo, which constitute a group of elements for improving the degree of supercooling (M). The ratio (y) of the compositions of the group of elements for improving the degree of supercooling (M) is in the range of 0<y≤6, and is based on the required property. If the ratio of the compositions of the group of elements for improving the degree of supercooling (M) is too high, the degree of supercooling is not improved, and the magnetic property decreases relatively.

The powder made of the iron-based metallic glass that is obtained in this way does not crystallize, even if it is cooled at a cooling rate that is slower than that of conventional iron-based metallic glass.

Thus by using a general-purpose mass production facility with a low cooling rate, powder made of the iron-based metallic glass that is a single amorphous phase, i.e., without a crystalline phase, can be easily manufactured. This is because an ability to form an amorphous phase is improved, since the degree of supercooling, ΔTx, which is the difference between the temperature to start crystallization, Tx, and the glass-transition temperature, Tg, is great.

These facts explain the ratios of the compositions of the respective elements in the basic composition. The powder made of the iron-based metallic glass of the present invention is obtained by adding an element for improving the corrosion resistance to the basic composition. Below it is discussed in detail.

First Embodiment

For the powder made of the iron-based metallic glass of the first embodiment, either or both of Cr and Zr, which are the elements for improving the corrosion resistance, are added to the basic composition. The content of the elements for improving the corrosion resistance is preferably 0.30-5.5 wt %, more preferably 1.0-4.0 wt %, further more preferably 1.0-2.0 wt %. Since an oxide film is formed on the surface of the powder made of the iron-based metallic glass by the Cr or Zr that is contained in it, the corrosion resistance is improved.

The elements for improving the corrosion resistance preferably include Al in addition. Cr and Zr both mainly contribute to form the oxide film on the surface of the powder made of the iron-based metallic glass. Al also contributes to form the oxide film on the surface of the powder made of the iron-based metallic glass. It also has an effect to increase the hardness of the oxide film that is formed by adding Cr or Zr. If the hardness of the oxide film increases, the corrosion resistance is further improved. Al contributes to improve the specific resistance of the powder made of the iron-based metallic glass. It also contributes to make the particles of the powder spherical when the powder made of the iron-based metallic glass is made by atomization, which is discussed below.

In this way, the powder made of the iron-based metallic glass that has excellent corrosion resistance and insulating property can be obtained by the synergistic effects of Cr or Zr plus Al. If the amount of Cr or Zr is too small, no sufficient corrosion resistance can be achieved. If it is too large, the magnetic property deteriorates, since the relative amount of the Fe decreases. If the amount of the Al is too small, no synergistic effects can be achieved. If it is too large, the magnetic property of the powder made of the iron-based metallic glass deteriorates and it becomes difficult to make the particles of the powder spherical.

To obtain the powder made of the iron-based metallic glass that has excellent corrosion resistance and an excellent insulating property by the synergistic effects of Cr or Zr plus Al, it is preferable that the content of the Al be 0.01-0.75 wt % and that of the elements for improving the corrosion resistance that include Al be 1.0-5.0 wt %. It is more preferable that the content of the Al be 0.03-0.50 wt % and that of the elements for improving the corrosion resistance that include Al be 1.5-1.9 wt %. By using the latter contents, not only the corrosion resistance but also the magnetic property and insulating property are further improved.

Further, it is preferable to use Cr and Al for the elements for improving the corrosion resistance, since the synergistic effects become apparent.

The powder made of the iron-based metallic glass of the present invention can be constituted only by Fe for the group of iron-based metallic elements that is expressed by $(Fe_{1-s-t}Co_sNi_t)_{100-x-y}$ in the nominal composition. The powder made of the iron-based metallic glass that has excellent corrosion resistance, an excellent magnetic property, and an excellent insulating property can be manufactured without containing Co or Ni.

The iron-based metallic glass, of which the corrosion resistance is improved in this way, can improve the magnetic property by adjusting the ratio of the compositions of either or both of Nb and Mo, which are a group of elements for improving the degree of supercooling, as follows. The ratios of the compositions of the group of elements for improving the degree of supercooling in the basic composition is preferably 0.05≤y≤2.4, more preferably 0.15≤y≤1.3. If the amount of Nb and Mo is too small, the ability to form the single amorphous phase is not improved, resulting in decreasing the magnetic property. Since Nb and Mo are rare metals that are expensive, the ratio of their contents is preferably the smallest in so far as the required magnetic property can be obtained. The ratio of the compositions of Nb and Mo is at the same level as the ratio of the compositions of both elements, because they are similar in chemical properties and their atomic radii and atomic weights are similar.

If the corrosion resistance or magnetic property is not acceptable when the ratio of the compositions of the group of elements for improving the degree of supercooling is within that range, either or both of B and P, which are the group of metalloid elements, are adjusted to be within the following range to improve the corrosion resistance and magnetic property.

The ratios of the compositions of the group of metalloid elements in the nominal composition $(Fe_{1-s-t}Co_sNi_t)_{100-x-y}$ are preferably (1.5:1)≤(m:n)≤(5.5:1); (3.5:6.5)≤(a:b)≤(5.5:4.5); and (6.0:4.0)≤(c:d)≤(8.5:1.5). They are more preferably (2.5:1)≤(m:n)≤(3.5:1); (4.3:5.7)≤(a:b)≤(5.2:4.8); and (6.5:3.5)≤(c:d)≤(7.0:3.0).

The amount of the element for improving the corrosion resistance must be minimized to obtain an excellent magnetic property. To minimize the amount of the element for improving the corrosion resistance a small amount of the following accessory elements for improving corrosion resistance may be added. The accessory elements for improving corrosion resistance include V, Ti, Ta, Cu, and Mn. At least one of them is added. The total amount of the accessory elements for improving corrosion resistance is preferably 0.03-0.70 wt %, more preferably 0.05-0.50 wt %, even more preferably 0.10-0.30 wt %. The accessory elements for improving corrosion resistance improve the corrosion resistance of the powder made of the iron-based metallic glass by forming an oxide film on the surface of it. Further, they improve the specific resistance of the powder made of the iron-based metallic glass by the synergistic effects of them plus the element for improving the corrosion resistance.

Next, the process for manufacturing the powder made of the iron-based metallic glass of the present invention is discussed. Atomization is known as a process for manufacturing powder made of the iron-based metallic glass. Atomization is broadly divided into water atomization, gas atomization, and centrifugal atomization.

Since the gas atomization and centrifugal atomization have an insufficient ability to cool particles with a large diameter (for example, about 200 μm) made of the iron-based metallic glass, a single amorphous phase may not be obtained. Thus they are not suitable to manufacture particles with a large diameter made of the iron-based metallic glass. Further, they have an insufficient ability to crush particles to manufacture particles with a small diameter (for example, 50 μm or less) made of the iron-based metallic glass. Thus they are not suitable to manufacture the particles with a small diameter made of the iron-based metallic glass.

The powder made of the iron-based metallic glass can be manufactured in the atmosphere by water atomization. It can be manufactured by the water atomization at a low cost for equipment and manufacturing. This atomization has no problems that exist in the gas atomizing and centrifugal atomizing. Because of these reasons, the water atomization is best for the process for manufacturing the powder made of the iron-based metallic glass of the present invention.

Below, the structure of the equipment for water atomization and the general process for manufacturing the powder made of the iron-based metallic glass of the present invention by using that equipment are discussed.

As shown in FIG. 1, the equipment for water atomization has a crucible for melting 1 that is formed by integrating a side wall with a bottom plate. The side wall has a vertical and cylindrical shape. The bottom plate has an orifice 5 for molten metal that is directed downward. The equipment also has an induction heating coil 2 that is placed as a helix on the whole outer surface of the side wall of the crucible for melting 1. It also has a stopper 3 for molten metal that is provided within the crucible for melting 1 to open and close the crucible for melting 1. It also has an atomizing nozzle 6 that is provided below the orifice 5 for molten metal.

Molten raw materials 4 (the basic composition of the elements, the element for improving the corrosion resistance, and, if necessary, the accessory elements for improving corrosion resistance) that correspond to the powder made of the iron-based metallic glass of the present invention are charged into the crucible for melting 1 after adjusting the ratio of the compositions so that the powder made of the iron-based metallic glass has predetermined compositions. Then, the molten raw materials 4 are heated to the melting point or above it by the induction heating coil 2 so that they are melted, to thereby form molten metal. The stopper 3 for the molten metal opens the orifice 5 for the molten metal to cause the molten metal to flow downwardly (molten raw materials 4) through the orifice 5. The atomizing nozzle 6 sprays water as to form a water screen below the orifice 5. The molten metal that has been flowing downwardly through the orifice 5 is crushed by colliding with the water screen, to be rapidly cooled down to solidify. The molten metal that has been caused to become powder by solidifying, drops into water 8 in a tank of water (not shown) that is placed below the atomizing nozzle. Thus it is further cooled. This powder is collected, dried and classified so that the powder made of the iron-based metallic glass that has the intended compositions and particle size is obtained.

The powder made of the iron-based metallic glass that is manufactured in the above process has a high degree of sphericity. Since the density of packed powder made of the iron-based metallic glass becomes high, a product, such as an electronic component, that has an excellent magnetic property, can be produced. For example, when a product such as an electronic component is produced from the powder made of the iron-based metallic glass, a magnetic core is produced by molding the powder made of the iron-based metallic glass by filling the powder in molds, as discussed later.

The diameter of a particle made of the iron-based metallic glass is preferably 0.5-200 μm (more preferably 0.5-100 μm, even more preferably 0.5-50 μm). If the particle is small, advantageous effects, such as decreasing the core loss when the magnetic core is made of powder made of the iron-based metallic glass, are achieved. If the particle is too small, the area of the oxide film on the surface becomes large compared to the volume. Thus the density of the powder made of the iron-based metallic glass decreases. Then high magnetic permeability cannot be achieved. If the particle is too large, it becomes difficult to decrease the core loss. Further, if the diameter of a particle is small, conventional powder made of the iron-based metallic glass becomes corrosive. However, the powder made of the iron-based metallic glass of the first embodiment has an excellent corrosion resistance when the diameter of a particle is as small as 0.5-50 μm.

Second Embodiment

Next, the powder made of the iron-based metallic glass of the second embodiment is discussed. Only the differences from the first embodiment are discussed.

For the powder made of the iron-based metallic glass of the second embodiment, at least one of V, Ti, Ta, Cu, and Mn as an element for improving the corrosion resistance is added to the basic composition. The total content of the elements for improving the corrosion resistance that includes these elements is preferably 0.03-0.70 wt %, more preferably 0.05-0.50 wt %, and even more preferably 0.10-0.30 wt %, in relation to the total weight of the powder. Since the element for improving the corrosion resistance forms an oxide film on the surface of the powder made of the iron-based metallic glass, the corrosion resistance is improved.

Though the powder made of the iron-based metallic glass of the second embodiment has lower corrosion resistance than does that of the first embodiment, it is usable when, for example, the corrosion rate is slow, because the diameter of a particle is large (for example, 50-200 μm) or the required corrosion resistance is not severe. Since the amount of the element for improving the corrosion resistance is very small, the manufacturing cost rarely increases.

By adjusting the ratio of the compositions of either or both of Nb and Mo, which is a group of elements for improving the degree of supercooling as shown in the following second embodiment, like in the first embodiment, the magnetic property is improved.

In the nominal composition, i.e., $(Fe_{1-s-t}Co_sNi_t)_{100-x-y}\{(Si_aB_b)_m(P_cC_d)_n\}_xM_y$, the ratio of the compositions of the group of elements for improving the degree of supercooling is preferably $0<y\leq 6.0$, more preferably $0.05\leq y\leq 2.3$, even more preferably $0.15\leq y\leq 1.3$. The ratio of the compositions of Nb and Mo is at the same level as is the ratio of the compositions of both elements, because they are similar in chemical properties and their atomic radii and atomic weights are similar.

The powder made of the iron-based metallic glass of the second embodiment can be manufactured by water atomization like that of the first embodiment.

EXAMPLES

To check the effects by the present invention, working examples and comparative examples are discussed.

The parameters in the nominal composition, i.e., $(Fe_{1-s-t}Co_sNi_t)_{100-x-y}\{(Si_aB_b)_m(P_cC_d)_n\}_xM_y$, of the basic compositions A-B-C-D, are listed in Table 1. Nb is used for the group M of elements for improving the degree of supercooling.

TABLE 1

| | n | t | n:b | o:d | m:n | x | y |
|---|---|---|---|---|---|---|---|
| Basic Composition A | 0 | 0 | 4.5:5.5 | 8.1:1.9 | 3.3:1.0 | 22.3 | 1.00 |
| Basic Composition B | 0 | 0 | 4.9:5.1 | 8.1:1.9 | 3.3:1.0 | 25.3 | 0.50 |
| Basic Composition C | 0.1 | 0.1 | 4.0:6.0 | 8.3:1.7 | 4.1:1.0 | 27.08 | 1.26 |
| Basic Composition D | 0 | 0 | 4.1:5.9 | 8.0:2.0 | 4.2:1.0 | 25.3 | 1.01 |

The basic compositions and the additive elements are adjusted to have the contents of the additive elements (the element for improving the corrosion resistance and the accessory element for also improving corrosion resistance) be those in Table 2. The respective mixed materials are melted in a high-frequency induction furnace to be processed by water atomization. Thus the respective kinds of powder are obtained.

<The Conditions for Water Atomization>

Pressure of water: 100 MPa

Flow of water: 100 L/min

Temperature of water: 20° C.

Diameter of orifice: 4 mm

Temperature of molten metal: 1,500° C.

TABLE 2

| | | Baic Composition | Additive Elements (wt %) | | | | | | | | Particle Diameter |
|---|---|---|---|---|---|---|---|---|---|---|---|
| | | | Cr | Al | Zr | V | Ti | Ta | Cu | Mn | (μm) |
| Working Example | 1 | A | 0.50 | — | — | — | — | — | — | — | 50 |
| | 2 | A | 1.00 | — | — | — | — | — | — | — | 50 |
| | 3 | A | 2.00 | — | — | — | — | — | — | — | 50 |
| | 4 | A | 4.00 | — | — | — | — | — | — | — | 50 |
| | 5 | A | 5.50 | — | — | — | — | — | — | — | 50 |
| | 6 | A | — | — | 1.50 | — | — | — | — | — | 50 |
| | 7 | B | 1.50 | — | — | — | — | — | — | — | 50 |
| Working Example | 8 | A | 1.50 | 0.01 | — | — | — | — | — | — | 50 |
| | 9 | A | 1.50 | 0.02 | — | — | — | — | — | — | 50 |
| | 10 | A | 1.50 | 0.04 | — | — | — | — | — | — | 50 |
| | 11 | A | 1.50 | 0.15 | — | — | — | — | — | — | 50 |
| | 12 | A | 1.50 | 0.30 | — | — | — | — | — | — | 50 |
| | 13 | A | 1.50 | 0.70 | — | — | — | — | — | — | 50 |
| | 14 | A | — | 0.05 | 1.50 | — | — | — | — | — | 50 |
| | 15 | B | 1.50 | 0.10 | — | — | — | — | — | — | 50 |
| Working Example | 16 | A | 1.50 | 0.75 | — | 0.01 | 0.01 | — | — | 0.01 | 50 |
| | 17 | A | 1.50 | 0.75 | — | 0.02 | 0.02 | — | 0.01 | — | 50 |
| | 18 | A | 1.50 | 0.75 | — | 0.02 | 0.02 | 0.02 | 0.02 | 0.02 | 50 |
| | 19 | A | 1.50 | 0.75 | — | 0.06 | 0.06 | 0.06 | 0.06 | 0.06 | 50 |
| | 20 | A | 1.50 | 0.75 | — | 0.10 | 0.10 | 0.10 | 0.10 | 0.10 | 50 |
| | 21 | A | 1.50 | 0.75 | — | 0.15 | 0.15 | 0.10 | 0.10 | 0.20 | 50 |
| | 22 | B | 1.50 | 0.75 | — | 0.03 | 0.03 | 0.03 | 0.03 | 0.03 | 50 |
| Working Example | 23 | C | — | — | — | 0.01 | 0.01 | — | — | 0.01 | 200 |
| | 24 | C | — | — | — | 0.02 | 0.02 | — | 0.01 | — | 200 |
| | 25 | C | — | — | — | 0.02 | 0.02 | 0.02 | 0.02 | 0.02 | 200 |
| | 26 | C | — | — | — | 0.06 | 0.06 | 0.06 | 0.06 | 0.06 | 200 |
| | 27 | C | — | — | — | 0.10 | 0.10 | 0.10 | 0.10 | 0.10 | 200 |
| | 28 | C | — | — | — | 0.15 | 0.15 | 0.10 | 0.10 | 0.20 | 200 |
| | 29 | D | — | — | — | 0.03 | 0.03 | 0.03 | 0.03 | 0.03 | 200 |
| Comparative Example | 1 | A | 0.10 | — | — | — | — | — | — | — | 50 |
| | 2 | A | 6.00 | — | — | — | — | — | — | — | 50 |
| | 3 | A | 1.50 | 0.01 | — | — | — | — | — | — | 50 |
| | 4 | A | 1.00 | 1.00 | — | — | — | — | — | — | 50 |
| | 5 | D | — | — | — | — | — | — | — | — | 200 |

The powder made by water atomization is collected to be dried by an oscillating vacuum dryer (VU-60, supplied by Chuo Kakoki Co., Ltd.) under the drying conditions listed below. Since it is dried under a vacuum by using the oscillating vacuum dryer, the drying process is carried out at an atmosphere that is hypoxic compared to a process carried out under the atmosphere. Further, it is dried at a low temperature for a short period. Since the powder made of the iron-based metallic glass that is to be dried is oscillated during the drying process, it can be dried within a short period, so that the powder made of the iron-based metallic glass is prevented from being flocculated or oxidized.

<The Conditions for Drying>

Drying temperature: 100° C.

Pressure in the Drying Room: −0.1 MPa (gauge)

Period for Drying: 60 min

The dried powder made of the iron-based metallic glass is classified by means of an air classifier (Turbo-Classifier, supplied by Nisshin Engineering Inc.) so that the particles having the intended diameter are classified. Thus the powder made of the iron-based metallic glass is obtained. The distribution by means of the diameters of the particles of the powder made of the iron-based metallic glass is measured by means of a laser diffraction particle size analyzer (SALD-2100, supplied by Shimadzu Corporation).

The powder made of the iron-based metallic glass that has been obtained by classification is mixed with a binder and an organic solvent to be granulated for material for molding by compaction. An epoxy resin is used for the binder and toluene is used for the organic solvent.

After the material for molding by compaction is heated at 80° C. for 30 min to be dried, it is screened by using a screen having a predetermined mesh so that coarse particles are removed. Thus the powdered material (granulated material) is obtained. The granulated material is filled in a forming die to be formed in the conditions listed below. Thus the compact (magnetic powder core 10) that is shown in FIG. 2 is obtained.

<The Conditions for Forming>

Process for Forming: forming by pressing

Shape of Compact: ring geometry

Size of Compact: Outside Diameter=13 mm; Inside Diameter=8 mm,

Thickness=6 mm

Pressure for Forming: 10 t/cm$^2$ (980 MPa)

By winding a conductor 11 around the compact 10 under the conditions listed below, a choking coil 9 is produced.

<The Conditions for Manufacturing Coil>

Material for Conductor: Cu

Diameter of Conductor: 0.5 mm

Number of Windings: Primary: 15 turns; Secondary: 15 turns

Next, the method of evaluation is described. The items to be evaluated are the following four items:

(1) Shape of powder made of iron-based metallic glass, (2) Corrosion resistance, (3) Magnetic property, and (4) Insulating property.

The ranking (◎, ○, Δ, X), which is below discussed, denotes the trend and outline of the results of experiments. It does not denote the evaluation of the magnetic powder core 10 or the choking coil 9 as a product. This is because the standard for evaluating a product depends on the requirements of the user of the product. In other words, different requirements are used for different users. Thus different standards may be used to evaluate the same product.

(1) Evaluating the shape of the powder made of the iron-based metallic glass The powder made of the iron-based metallic glass that has been manufactured by drying and classifying the powder made by water atomization is observed through a microscope. Based on the following evaluated classes, the spherical shapes of the powder made of the iron-based metallic glass are evaluated.

<Evaluated Classes>

◎: 75% or more of whole particles are spheres. The remaining particles are not spherical, but have roundish shapes. No particle has a corner.

○: 50-75% of whole particles are spheres. The remaining particles are not spherical, but have roundish shapes. No particle has a corner.

Δ: 25-50% of whole particles are spheres. 50% or more of the remaining particles are not spherical, but have roundish shapes. 50% or less of the remaining particles have a corner.

X: 25% or less of whole particles are spheres. 50% or more of the remaining particles are not spherical, but have roundish shapes. 50% or less of the remaining particles have a corner.

(2) Evaluating the Corrosion Resistance

After leaving the magnetic powder core 10 in the space at a room temperature of 60° C. and a humidity (RH) of 95% for 168 hours, the points of rust on the outer surface of it are counted by visual observation. The counted points of rust are ranked based on the following evaluated classes to evaluate the corrosion resistance.

<Evaluated Classes>

◎: No rust is observed.

○: One to five points of rust are observed.

Δ: Six to ten points of rust are observed.

X: Ten points or more, or one area or more, of rust, are observed.

(3) Evaluating the Magnetic Property

As shown in FIG. 2, the choking coils 9 are connected to the measuring device 12 (a device for measuring alternative magnetic properties; B-H Analyzer SY8258, supplied by Iwatsu Test Instruments Corp.). The magnetic permeability and the loss of magnetism are measured under the conditions of measuring frequency=200 kHz and the maximum magnetic flux density=50 mT. The measured results are ranked based on the following evaluated classes to evaluate the magnetic property.

<Evaluated Classes>

◎: Within the class listed below as "○", the magnetic permeability (μ) exceeds 30 and is extremely high, or the loss of magnetism is 1,000 (kW/m$^3$) or less and is extremely low.

○: The magnetic permeability (μ) is 30 or more and the loss of magnetism is less than 1,000 (kW/m$^3$).

Δ: The magnetic permeability (μ) is 30 or more and the loss of magnetism is 1,000 (kW/m$^{3)}$ or more, or the magnetic permeability (μ) is less than 30 and the loss of magnetism is less than 1,000 (kW/m$^3$).

X: The magnetic permeability (μ) is less than 30 and the loss of magnetism is 1,000 (kW/m$^3$) or more.

(4) Evaluating the Insulating Property.

<Conditions for Measurements>

By applying a voltage of 500 V to the magnetic powder core 10 the insulation resistance is measured by a device for measuring insulation resistances (TOS9200, supplied by Kikusui Electronics). The results measured are ranked based on the following evaluated classes, ◎, ○, Δ, or X, to evaluate the insulating property.

<Evaluated Classes>

◎: The insulation resistance is 1 GΩ or more.

○: The insulation resistance is 500 MΩ or more and less than 1 GΩ.

Δ: The insulation resistance is 100 MΩ or more and less than 500 MΩ.

X: The insulation resistance is less than 100 MΩ.

The results of tests for the working and comparative examples for both the first and the second embodiment are shown in Table 3. The results of the evaluation are discussed below.

(1) First embodiment (working examples 1-22; comparative examples 1-4) The results of the evaluation are shown in Table 3. The powder made of the iron-based metallic glass of the first embodiment, which contains either or both of Cr and Zr, which are the elements for improving the corrosion resistance, is confirmed to have excellent corrosion resistance and magnetic property (working examples 1-7). Especially, if the content of the elements for improving the corrosion resistance is within the preferable range, the measured values tend to slightly increase, though no qualitative evaluation changes (working examples 2, 3, and 7).

By adding Al, which is the element for improving the corrosion resistance, the sphericity is improved. If the contents of the Al and the sum of Cr plus Zr are properly adjusted, it is confirmed that the magnetic property and insulating property are improved (working examples 8-15). Especially, if the content of the Al is 0.04-0.15 wt % and the content of the sum of Cr plus Zr is 1.5-1.90 wt %, it is confirmed that the magnetic property and insulating property are excellent.

In working examples 16-22, wherein the accessory element for improving corrosion resistance is added together with Cr and Al, which are the elements for improving the corrosion resistance, the measured values in the insulating property tend to increase, though no qualitative evaluation changes.

For the element for improving the corrosion resistance, comparative examples 1-4, wherein the content of Cr or Al is too low or too high, are evaluated. If the content of the Cr is too low (comparative example 1), the evaluation for corrosion resistance becomes "Δ." Thus it is confirmed that too low a content of Cr tends not to improve the corrosion resistance. If the content of the Cr is too high (comparative example 2), the evaluation for the magnetic property becomes "X" and the evaluation for the insulating property becomes "Δ." Thus it is confirmed that too high a content of the Cr tends to deteriorate the properties that are needed for the powder made of the iron-based metallic glass, though the corrosion resistance is improved. If the content of the Al is too low (comparative example 3), the evaluation becomes the same as that of working example 2. Thus it is confirmed that too low a content of the Al tends not to improve the corrosion resistance. If the content of the Al is too high (comparative example 4), then the evaluation for the shape and magnetic property becomes "X" and the evaluation for the insulating property becomes "Δ." Thus it is confirmed that too high a content of the Al tends to deteriorate not only the shapes, but also the properties that are needed for the powder made of the iron-based metallic glass, though the corrosion resistance is improved.

(2) Second Embodiment (Working Examples 23-29)

The powder made of the iron-based metallic glass of the second embodiment, which includes at least one of V, Ti, Ta, Cu, and Mn, which are the elements for improving the corrosion resistance, is confirmed to have excellent corrosion resistance, compared to comparative example 5, which contains no element for improving the corrosion resistance. If the elements for improving the corrosion resistance are added within the preferable range, the measured insulating property is confirmed to tend to slightly increase, though no qualitative evaluation changes. Further, if they are added within the more preferable range, the evaluation for the insulating property is confirmed to further increase (working examples 24-27 and 29).

TABLE 3

| | | Evaluated Items | | | |
|---|---|---|---|---|---|
| | | Shape | Corrosion Resistance | Magnetic Property | Insulating Property |
| Working Example | 1 | ○ | ○ | ○ | ○ |
| | 2 | ○ | ◎ | ○ | ○ |
| | 3 | ○ | ◎ | ○ | ○ |
| | 4 | ○ | ◎ | ○ | ○ |
| | 5 | ○ | ○ | ○ | ○ |
| | 6 | ○ | ◎ | ○ | ○ |
| | 7 | ○ | ◎ | ○ | ○ |
| Working Example | 8 | ◎ | ◎ | ○ | ○ |
| | 9 | ◎ | ◎ | ◎ | ○ |
| | 10 | ◎ | ◎ | ◎ | ◎ |
| | 11 | ◎ | ◎ | ◎ | ◎ |
| | 12 | ◎ | ◎ | ◎ | ○ |
| | 13 | ◎ | ◎ | ○ | ○ |
| | 14 | ◎ | ◎ | ◎ | ◎ |
| | 15 | ◎ | ◎ | ◎ | ◎ |
| Working Example | 16 | ◎ | ◎ | ◎ | ◎ |
| | 17 | ◎ | ◎ | ◎ | ◎ |
| | 18 | ◎ | ◎ | ◎ | ◎ |
| | 19 | ◎ | ◎ | ◎ | ◎ |
| | 20 | ◎ | ◎ | ◎ | ◎ |
| | 21 | ◎ | ◎ | ◎ | ◎ |
| | 22 | ◎ | ◎ | ◎ | ◎ |
| Working Example | 23 | ○ | ◎ | ○ | ○ |
| | 24 | ○ | ◎ | ○ | ○ |
| | 25 | ○ | ◎ | ○ | ○ |
| | 26 | ○ | ◎ | ○ | ○ |
| | 27 | ○ | ◎ | ○ | ○ |
| | 28 | ○ | ◎ | ○ | ○ |
| | 29 | ○ | ◎ | ○ | ○ |
| Comparative Example | 1 | ○ | Δ | ○ | ○ |
| | 2 | ○ | ○ | X | Δ |
| | 3 | ○ | ◎ | ○ | ○ |
| | 4 | X | ◎ | X | Δ |
| | 5 | ○ | Δ | ○ | ○ |

Below, the main numerals that are used in the detailed description and the drawings are listed.

1. a crucible for melting
2. an induction heating coil
3. a stopper for molten metal
4. molten raw materials
5. an orifice
6. an atomizing nozzle
7. a water curtain
8. water
9. a choking coil
10. a magnetic powder core
11. a conductor
12. a measuring device

INDUSTRIAL APPLICABILITY

Though in the embodiments the powder made of the iron-based metallic glass of the present invention is described to be used for a magnetic powder core for inductors, etc., the usage of it is not limited to this. For example, it is preferably used for a material for a sheet for suppressing noise that is used for electronic components. Further, the powder made of the iron-based metallic glass may be dissolved in a solvent, such as an epoxy resin, so that a solution is prepared. That solution may be used for screen printing to manufacture electronic circuits. The powder made of the iron-based metallic glass of the present invention is widely and preferably used for electronic components that are required to have an excellent corrosion resistance, an excellent magnetic property, and an excellent insulating property.

The invention claimed is:

1. Corrosion-resistant powder made of iron-based metallic glass, wherein the iron-based metallic glass comprises one or more iron-group elements, a group of metalloid elements, and at least one element M for improving a degree of supercooling (M: either or both of Nb and Mo), wherein a nominal composition of the iron-based metallic glass is expressed by $(Fe_{1-s-t}Co_sNi_t)_{100-x-y}\{(Si_aB_b)_m(P_cC_d)_n\}_xM_y$ wherein ratios of the compositions of the group of iron-based metallic elements are $19 \le x \le 30$, $0 < y \le 6.0$, $0 \le s \le 0.35$, $0 \le t \le 0.35$, and $s+t \le 0.35$, wherein ratios of the compositions of the group of metalloid elements are $(0.5:1) \le (m:n) \le (6:1)$; $(2.5:7.5) \le (a:b) \le (5.5:4.5)$; and $(8.0:2.0) \le (c:d) \le (8.5:1.5)$, further comprising either or both of Cr and Zr as an element for improving corrosion resistance of the powder, the content of the Cr and Zr being 0.30-50 wt % in relation to the total contents of all the elements in the nominal composition, and further comprising Al in a content of 0.01-0.75 wt % for improving the corrosion resistance of the powder, and the total content of the Cr, Zr and Al being 1.0-5.0 wt %.

2. The corrosion-resistant powder made of the iron-based metallic glass of claim 1, wherein the nominal composition is expressed by $Fe_{100-x-y}\{(Si_aB_b)_m(P_cC_d)_n\}_xM_y$.

3. The corrosion-resistant powder made of the iron-based metallic glass of claim 1, wherein $0.05 \le y \le 2.4$.

4. The corrosion-resistant powder made of the iron-based metallic glass of claim 3, wherein $(1.5:1) \le (m:n) \le (5.5:1)$; and $(3.5:6.5) \le (a:b) \le (5.5:4.5)$.

5. The corrosion-resistant powder made of the iron-based metallic glass of claim 1, further including at least one accessory element for improving corrosion resistance selected from V, Ti, Ta, Cu, and Mn, wherein a content of the accessory elements for improving corrosion resistance is 0.03-0.70 wt %.

6. The corrosion-resistant powder made of the iron-based metallic glass of claim 1, wherein a diameter of a particle of the powder is 0.5-50 μm.

7. The corrosion-resistant powder made of the iron-based metallic glass of claim 1, wherein the powder is manufactured by water atomization.

8. The corrosion-resistant powder made of the iron-based metallic glass of claim 1, further comprising at least one of V, Ti, Ta, Cu, and Mn for improving the corrosion resistance of the powder.

* * * * *